US008656689B2

(12) United States Patent
Denome et al.

(10) Patent No.: US 8,656,689 B2
(45) Date of Patent: Feb. 25, 2014

(54) POUCH MANUFACTURE AND USES

(75) Inventors: Frank William Denome, Cincinnati, OH (US); Dennis Allen Beckholt, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1579 days.

(21) Appl. No.: 11/784,675

(22) Filed: Apr. 9, 2007

(65) Prior Publication Data

US 2007/0241022 A1 Oct. 18, 2007

Related U.S. Application Data

(60) Provisional application No. 60/791,291, filed on Apr. 12, 2006.

(51) Int. Cl.
*B65B 43/08* (2006.01)

(52) U.S. Cl.
USPC ..... 53/456; 53/453; 53/432

(58) Field of Classification Search
USPC ..... 53/453, 427, 455, 456, 467, 559, 475, 53/450, 474, 432, 470, 478
See application file for complete search history.

(56) References Cited

U.S. PATENT DOCUMENTS

| | | | | |
|---|---|---|---|---|
| 7,013,623 | B2 * | 3/2006 | Fisher et al. | 53/453 |
| 7,386,971 | B2 * | 6/2008 | Catlin et al. | 53/537 |
| 7,464,519 | B2 * | 12/2008 | Fisher et al. | 53/453 |

FOREIGN PATENT DOCUMENTS

| | | | |
|---|---|---|---|
| EP | 1 337 619 | B1 | 3/2005 |
| WO | WO 02/085736 | A1 | 10/2002 |
| WO | WO 02/085738 | A1 | 10/2002 |

* cited by examiner

*Primary Examiner* — Christopher Harmon
(74) *Attorney, Agent, or Firm* — Matthew P. Fitzpatrick; Steven W. Miller

(57) ABSTRACT

A process for making a multi-compartment water-soluble pouch having at least three compartments and wherein at least one of the compartments contains a composition in liquid form, the process comprising the steps of:

a) providing a mold with at least two recesses;
b) drawing a first film into the mold to form at least two open compartments in the at least two recesses;
c) filling the open compartments;
d) pin-pricking the first film to create a pin-hole;
e) drawing a second film over the open compartments to close those compartments and to form a new open compartment, wherein the second film directly covers the pin-hole;
f) filling the open compartment formed from the second film; and
g) placing a closure film over the new filled open compartment to close it.

1 Claim, No Drawings

POUCH MANUFACTURE AND USES

CROSS REFERENCE TO RELATED APPLICATION

This application claims the benefit of U.S. Provisional Application No. 60/791,291, filed Apr. 12, 2006

TECHNICAL FIELD

The present invention is in the field of pouches and pouch manufacture, in particular it relates to fluid-containing multi-compartment water-soluble pouches and their use for cleaning applications.

BACKGROUND OF THE INVENTION

The use of water-soluble pouches for different applications, especially for cleaning applications, has become increasingly popular. Among many other advantages pouches avoid the contact of the user with the cleaning composition which may contain bleach and/or other irritant substances.

Processes for making dual-compartment pouches are known in the art. For example WO 02/085736 describes a process for preparing a water-soluble container comprising at least two compartments, each compartment being filled with a composition, and covering each compartment with a lid such that the compartments are joined by a folding portion; and folding the folding portion such that the lids of each of the compartments adhere to each other.

WO02/085738 describes a process for producing a water-soluble article comprising a first compartment containing a first composition and a second compartment comprising a second composition, which comprises producing a first compartment; filling the first compartment with the first composition and either providing a sealing film comprising the second composition and sealing the first compartment with the sealing film or sealing the first compartment with a sealing film; producing a second compartment from the first compartment and/or the sealing film of the first compartment; filling the second compartment with the second composition; and sealing the second compartment with a second sealing film.

EP-A-1,337,619 discloses a process for making a water-soluble pouch which comprises a plurality of compartments in generally superposed or superposable relationship.

Most of the dual or multi-compartment pouches described in the prior art are made by a horizontal forming process and as a result the compartments are arranged in a superposed manner. In general the compartments have similar geometry and dimensions. The available making pouches processes do not seem to provide flexibility with respect to the arrangement, size and geometry of the different compartments.

Often the geometry and size of the pouch is determined by its application, for example in the case of pouches for use in automatic dishwashing machines, the geometry and size of the pouch may be dictated, among other things, by the shape of the detergent dispenser compartment. In the case of dual or multi-compartment pouches the compartments are usually arranged in superposed manner and seem to be very shallow and sometimes a large part of the compartments may be occupied by air, this is particularly so in the case of compartments comprising a liquid composition.

Another drawback that can be found in the case of multi-compartments pouches is the requirement of intermediate films to separate compartments from one another.

There is still a need for a process for making multi-compartment pouches which gives flexibility on the size and shape of the pouch compartments and which use a reduced amount of film.

SUMMARY OF THE INVENTION

According to a first aspect of the present invention, there is provided a process for making a multi-compartment water-soluble pouch having at least three compartments and wherein at least one of the compartments contains a composition in liquid form, preferably at least two, more preferably at least three of the compartments and especially all the compartments contain a composition in liquid form. Generally, pouches having compartments containing compositions in liquid form may contain a large amount of air, because it is very difficult to evacuate the air without contamination of the sealing area. Contamination of the sealing area can translate into a weak seal. Therefore, a requirement during the sealing process is to maintain the liquid level in the open pouch at a certain distance below the sealing area of the pouch. This requirement gives rise to pouches having a considerable volume occupied by air as compared with the volume occupied by liquid. As discussed above, this phenomenon is more acute in case of pouches with shallow compartments. Another problem found in the case of liquid containing pouches is that it may not be possible to use vacuum to evacuate the air from the compartments. Usually vacuum is applied through pin holes, however in the case of liquids pin holes cannot be used because the liquid would leak through the hole.

The process of the invention comprises the steps of:

a) providing a mould with at least two recesses;
b) drawing a first film into the mould to form at least two open compartments in the at least two recesses;
c) filling the open compartments with two compositions, preferably two cleaning compositions that can be the same or different;
d) pin-pricking the first film to create a pin-hole;
e) drawing a second film over the open compartments to close those compartments and to form a new open compartment, wherein the second film directly covers the pin-hole;
f) filling the open compartment formed from the second film with a composition, preferably a cleaning composition, that can be the same or different from the two other compositions; and
g) placing a closure film over the new filled open compartment to close it.

In preferred embodiments the at least two recesses are connected by means of a bridge region which separates the two recesses, this configuration will give rise to two separate compartments. This is especially useful in the case in which the two compartments contain compositions that are prone to interact with one another impairing on the stability of the product. The region of the film placed over the bridge region it is also called herein bridge region. The moulds used in the process of the invention can have more than two recesses, for example three or four and more than one bridge region.

The first film can be drawn into the mould by any means including pressure, vacuum, convention, etc. as well as by forming the film by injection moulding. Preferably the first film is drawn by means of vacuum. The drawing process can also be help by heating the film.

In embodiments in which the at least two recesses are joined by a bridge region the film is pin-pricked to form a pin-hole in the bridge region, the pin hole can be formed before of after filling the two compartments.

The two open compartments are filled, simultaneously or in sequence, with two similar or different compositions, preferably cleaning compositions. By "cleaning composition" herein is meant a composition which by itself or in combination with other composition(s) is capable to contribute to the cleaning of a substrate.

The drawing of the second film, to close the pre-formed open compartments and to create a new open compartment, can, as in the case of the first film, be achieved by any know means, including pressure, vacuum, convention, etc. In a preferred embodiment, the second film is drawn by vacuum means. The drawing process can be help by heating the film. The presence of the pin-hole allows the evacuation of the air which could be entrapped between the first formed open compartments and the second film, thereby increasing the amount of composition that can be hold in each compartment and improving the appearance of the pouch. Preferably, the first and second films are sealed together.

After the newly formed compartment is filled with a composition, preferably in liquid form, similar or different to those of the at least two previously formed compartments the open compartment is closed with a closure film and the second and closure films are sealed together. Alternative the first, second and closure film can be sealed together in a single step.

According to a second aspect of the invention there is provided a multi-compartment water-soluble pouch having at least three compartments and wherein at least one of the compartments contains a composition in liquid form, preferably at least two, more preferably at least three of the compartments and especially all the compartments contain a composition in liquid form. The pouch of the invention have only a bottom, middle and top film. The bottom and the middle films form at least two compartments (herein referred to as bottom compartments). The bottom film comprises a pin-hole and at least part of the middle film is placed directly over the pin-hole. The middle and the top films form another compartment (herein referred to as second compartment). The pouch of the invention requires less film than conventional pouches, for example a three compartment pouch only requires one middle film. The pouches of the invention are especially suitable for use in cleaning processes and in particular for laundry and automatic dishwashing.

In preferred embodiments, the two compartments formed from the bottom film (i.e. bottom compartments) are in a side-by-side spatial relationship. Preferably, the two bottom compartments are separated by a bridge region (i.e., there is a gap, preferably horizontal, between them), instead of being separated just by a wall, thereby improving the stability of the two bottom compartments, especially if the two compartments comprise incompatible substances that could migrate through the film from one compartment to the other. In preferred embodiments, the pouch comprises two side-by-side compartments and another compartment superposed onto the two side-by-side compartments. These embodiments permit the visualization of the three compartments as well as an improvement on the appearance and stability of the pouch.

The pouches of the invention easily allow for the separation of incompatible ingredients. In preferred embodiments a compartment, preferably one of the bottom compartments comprises enzymes and another compartment, preferably other bottom compartment comprises bleach.

In preferred embodiments the top and bottom films have different dissolution profiles, thereby releasing the contents of the corresponding compartments at different times, this allows for the delivery of different compositions into the pre-wash, main wash and/or rinse cycles or even in different parts of any of the cycles.

DETAILED DESCRIPTION OF THE INVENTION

The present invention envisages a process for making multi-compartment water-soluble pouches having at least three compartments wherein at least one of the compartments comprises a liquid composition. The process allows for reduction on the amount of film, reduction on the amount of air entrapped in the pouch and flexibility on the design of the compartments. The resulting pouches present improved aesthetics and stability.

The invention also envisages multi-compartment pouches having at least three compartments wherein at least one of the compartments comprises a liquid composition and executions which allow differential delivery of compositions contained in different compartments.

The term "liquid" as used herein includes gels and pastes. The term "pouch" as used herein includes sachets and capsules.

The process of the invention requires the use of a mould with at least two recesses. Preferably the mould has double/multiple depth. It is preferred that the two recesses are at the bottom of the mould (to give rise to the bottom compartments) and that the mould has enough space to allow for the formation of other compartment(s) on top of the bottom compartments. This configuration simplifies the manufacture of multi-compartment pouches, because the whole pouch can be made in a single mould, avoiding the transfer of pre-formed compartments that always adds complexity to the process.

The recesses of the mould can have any geometry, for example, semicircular, square, triangular, rectangular, disc shape, or in the form of well known shapes, such as in the shape of a star, a fruit, etc. The two recesses can have the same or different geometry, shape and/or size. The process of the invention provides a great flexibility of geometries, this is not only preferred from the aesthetic point of view but also from the point of view of reducing the amount of air entrapped in each compartment, in particular when the compartments contain a composition in liquid form.

Preferably moulds for use herein are those having at least two recesses joined by a bridge region. Preferably, the at least two recesses are at the bottom of the mould.

The process of the invention can be carried out in a continuous, semi-continuous or batch manner, using any suitable equipment. The pouches can be individually made or alternatively a web of pouches can be made and then the individual pouches can be separated from the web.

The process of the invention can be implemented by forming a first web, preferably a moving web. The process preferably involves continuously feeding the first water-soluble film onto an endless surface, preferably onto a horizontal or substantially horizontal portion of an endless surface, or otherwise, onto a non-horizontal portion of this surface, such that it moves continuously towards and eventually onto the horizontal or substantially horizontal portion of the surface. The first web could alternatively be formed by injection moulding.

Each mould used to form the first web has at least two recesses, after drawing the first film onto the moulds at least two different open compartments would be formed in each mould.

Preferably, a surface containing the mould is part of and/or preferably removably connected to a moving, rotating belt, for example a conveyer belt or platen conveyer belt. Then preferably, the surface can be removed and replaced with another surface having other dimensions or comprising moulds of a different shape or dimension. This allows the equipment to be cleaned easily and moreover to be used for the production of different types of pouches. This may for example be a belt having a series of platens, whereof the number and size will depend on the length of the horizontal portion and diameter of turning cycles of the surface, for example having 50 to 150 or even 60 to 120 or even 70 to 100 platens, for example each having a length (direction of motion of platen and surface) of 5 to 150 cm, preferably 10 to 100 cm or even 20 to 45 cm.

The platens then form together the surface or part thereof and typically the moulds are comprised on the surface of the platens, for example each platen may have a number of moulds, for example up to 20 moulds in the direction of the width, or even from 2 to 10 or even 3 to 8, and for example up to 15 or even 1 to 10 or even 2 to 6 or even 2 to 5 moulds lengthwise, i.e. in the direction of motion of the platens.

The surface, or typically the belt connected to the surface, can be continuously or intermittently moved by use of any known method. Preferred is the use of a zero-elongation chain system, which drives the surface or the belt connected to the surface.

If a platen conveyer belt is used, this preferably contains a) a main belt (preferably of steel) and b) series of platens, which comprise 1) a surface with moulds, such that the platens form an endless surface with moulds, and 2) preferably a vacuum chute connection and 3) preferably a base plate between the platens and the vacuum chute connection. Then, the platens are preferably mounted onto the main belt such that there is no air leakage from junctions between platens. The platen conveyer belt as a whole moves then preferably along (over; under) a static vacuum system (vacuum chamber).

Preferred may be that the surface is connected to two or more different vacuum systems, which each provide a different under pressure and/or provide such an under pressure in shorter or longer time-span or for a shorter or longer duration. For example, it may be preferred that a first vacuum system provides a under-pressure continuously on the area between or along the moulds/edges and another system only provides a vacuum for a certain amount of time, to draw the film into the moulds. For example, the vacuum drawing the film into the mould can be applied only for 0.2 to 5 seconds, or even 0.3 to 3 or even 2 seconds, or even 0.5 to 1.5 seconds, once the film is on the horizontal portion of the surface. This vacuum may preferably be such that it provides an under-pressure of between −100 mbar to −1000 mbar, or even from −200 mbar to −600 mbar.

Preferred may be for example that the two or more vacuum systems, or preferably pumps are connected to the chutes described above, such that each vacuum system is connected to each chute, preferably such that the systems are not interconnected with in the chute, to thus completely separate the vacuums from one another and to guarantee controlled delivery of vacuum to the moulds/surface between/along mould/edges.

The surface, or platens described above, are preferably made from corrosion resistant material, which is durable and easy to clean. Preferred may be that the surface or platens, including the mould areas are made of aluminium, preferably mixed with nickel, or optionally only the outside layers comprising nickel and/or nickel aluminium mixtures.

Preferably, at least the top layer between and/or in the moulds of the surface is of deformable resilient material, preferably at least the top layer between the moulds. The material is typically such that it has a friction coefficient of 0.1 or more, preferably 0.3 or more. For example, the top layer between the moulds, but even in the moulds, can be of rubber, silicon material or cork, preferably rubber or silicon rubber. Preferred is also that the material is not too hard, for example similar to silicon rubber having a shore value of 10 to 90.

The moulds can have any shape, length, width and depth, depending on the required dimensions of the pouches. Per surface, the moulds can also vary of size and shape from one to another, if desirable. For example, it may be preferred that the volume of the final pouches is between 5 and 100 ml, or even 10 and 50 ml or even 15 and 30 ml. The mould sizes are adjusted accordingly.

The feeding of the film to, and typically onto or on top of the surface and preferably onto the horizontal portion thereof, can be done continuously or intermittently, preferably continuously and thus typically with a constant speed throughout the process. This can be done by any known method, preferably by use of rollers from which the film unwinds. The film can be transported from the rollers to the surface by any means, for example guided by a belt, preferably a deformable resilient belt, for example a belt of rubber or silicone material, including silicone rubber. The material is typically such that it has a friction coefficient of 0.1 or more, preferably 0.3 or more.

Preferred may be that the rollers rewind the film with a speed of at least 100 m/min, or even 120 to 700 m/min, or even 150 to 500 m/min, or even 250 to 400 m/min.

Once on the surface, the film can be held in position, e.g. fixed or fixated on the surface, by any means. For example, the film can be held with grips or clips on the edges of the surface, where there are no moulds, or pressed down with rollers on the edges of the surface, where there are no moulds, or held down by a belt on the edges of the surface, where there are no moulds.

For ease of operating and film positioning, for improved accuracy and better alignment reliability, and as to not loose too much of the film surface (i.e. positioned in or under the grips, clips rollers or belt), and moreover as to reduce the tension on the film or ensure more homogeneous tension on the film, it is preferred that the film is held in position by application of vacuum on the film, thus drawing or pulling the film in fixed position on the surface. Typically this is done by applying a vacuum (or under-pressure) through the surface which is to hold the film, e.g under the film. Also, this method is suitable even if the film width is larger than the surface, so this system is more flexible than the use of grips of clips.

Preferably, the vacuum is applied along the edges of the film and thus typically the edges of the surface, and/or on the surface area between or around the moulds, typically along the edges of the moulds. Preferred is that the vacuum is (at least) applied along the edges of the surface.

Preferably, said surface thereto comprises holes which are connected to a device which can provide a vacuum, as known in the art, or so-called vacuum chamber(s). Thus, the surface has preferably holes along the edges of the surface and/or holes around or between the moulds.

Preferred is that the holes are small, preferably of a diameter of 0.1 mm to 20 mm, or even 0.2 to 10 mm or even 0.5 to 7 or even 1 to 5 mm.

Preferably, at least some of the holes are close to the mould edges, to reduce wrinkling in the area around the mould edges, which in a preferred embodiment herein serves as closing or sealing area; preferably the distance between the edge of the mould and the edge of the first or closest hole is 0.25 to 20 mm form the edge of the mould, or even preferably 0.5 to 5 mm or even 1 to 2 mm.

Preferred is that rows of holes are present along the edge of the surface and/or along the edges of the moulds; preferred may be that 2 or 3 or more rows of holes are present.

The use of many small holes in the manner described above ensures more homogeneous tension of the film, and it reduces the tension needed to fixate the film, and it improves the fixation and it reduces the chance of wrinkling of the film.

The use of a vacuum to fix the film in position is in particular beneficial when the film is subsequently drawn into the moulds by application of a vacuum as well, as described herein after.

The open compartments can be formed in the moulds by any method, and as described above, preferred methods include the use of (at least) a vacuum or under-pressure to draw the film into the moulds. Preferred methods (also) include heating and/or wetting the film and thereby making the film more flexible or even stretched, so that it adopts the shape of the mould; preferably, combined with applying a vacuum onto the film, which pulls the film into the moulds, or combinations of all these methods. Preferred is that at least vacuum is used herein. In the case of pouches comprising powder containing compartments it is advantageous to pin prick the film for a number of reasons: firstly, to reduce the possibility of film defects during the pouch formation, for example film defects giving rise to rupture of the film can be generated if the stretching of the film is too fast, secondly to permit the release of any gases derived from the product enclosed in the pouch, as for example oxygen formation in the case of powders containing bleach, and thirdly, to allow the continuous release of perfume. When also heat and/or wetting is used, this can be used before, during or after the use of the vacuum, preferably during or before application of the vacuum.

Preferred is thus that each mould comprises one or more holes which are connected to a system which can provide a vacuum through these holes, onto the film above the holes, as described herein in more detail. Preferred is that the vacuum system is a vacuum chamber comprising at least two different units, each separated in different compartments, as described herein.

Heat can be applied by any means, for example directly, by passing the film under a heating element or through hot air, prior to feeding it onto the surface or once on the surface, or indirectly, for example by heating the surface or applying a hot item onto the film, for example to temperatures of 50 to 120° C., or even 60 to 90° C., preferably for example with infra red light.

The film can be wetted by any mean, for example directly by spraying a wetting agent (including water, solutions of the film material or plasticisers for the film material) onto the film, prior to feeding it onto the surface or once on the surface, or indirectly by wetting the surface or by applying a wet item onto the film.

Once the first web of pouches is formed it is pin-pricked to form pin-holes, the pin-holes are preferably placed between the bottom compartments, preferably in the bridge region of the film. The filling of the open compartments can be done by any known method. The exact most preferred method depends on the product form and speed of filling required.

Generally, preferred methods include continuous motion in line filling, which uses a dispensing unit positioned above the open compartments which has a endless, rotating surface with nozzles, which typically moves rotatably with continuous motion, whereby the nozzles move with the same speed as the open compartments and in the same direction, such that each open compartment is under the same nozzle or nozzles for the duration of the dispensing step. After the filling step, the nozzles rotate and return to the original position, to start another dispensing/filling step. Every nozzle or a number of nozzles together, is preferably connected to a device which can accurately control that only a set amount or volume of product is dispensed during one rotation per nozzle.

Preferred may be that the filling/dispensing system is such that from 10 to 100 cycles (filling steps) can be done per minute, or even 30 to 80 or even 40 to 70 per minute. This will of course be adjusted depending o the size of the open compartments, speed of the surface etc.

A highly preferred method for filling the open compartments suitable for surface moving in horizontal rectilinear motion is a reciprocating-motion-filling method. This process preferably uses a moving filling station which is returnable (changes direction of motion) and variable in speed. The filling station has typically a series of nozzles which each move with the same speed as the open compartments (to be filled) and in the same direction for the period that product needs to dispensed into the open compartments. Then, typically when a compartment is full, the nozzle or nozzles which filled the compartment stop their movement along with the open compartment and return in opposite direction, to then stop again, such that it is positioned above another open compartment(s) which is (are) still to be filled, and to then start moving again in opposite direction, with the same speed and direction as the open compartments, until it reaches the speed of the open compartments, to then continue with this speed and start dispensing and filling of the compartment(s), as in the previous filling cycle. The speed of the returning movement may be higher than the speed of the movement during filling.

Every nozzle or a number of nozzles together is preferably connected to a device which can accurately control that only a set amount or volume of product is dispensed during one rotation per nozzle, e.g. thus in one open compartment.

The filling unit or station used in the process of the invention preferably uses a flow meter and/or positive displacement pump to dose the correct amounts or volumes of product per open compartment, in particular a positive displacement pump has been found to very accurate. Hereby, the required amount or volume of product is introduced in the pump and this is then fed to the nozzles. For example, if the system is such that 60 open compartments are to be filled per filling cycle, typically 60 nozzles are provided, connected to 60 positive displacement pumps (one pump per nozzle, per pouch), which are all connected to a general tank with product.

The pumps can be adjusted depending on the product to be dispensed. For example, if the product is a viscous liquid, the pumps need to be stronger, if a fast filling, and thus movement of the surface is required.

Other methods which can be used include flow measurement, by use of a magnetic flow meter or mass flow meter, and pressure flow filling/measurement (which keeps the pressure constant and controlling filling time and thereby volume).

It can also be preferred to use a filling system whereby, prior to filling, a second surface with openings, which each has a surface area equal or less than the surface area of an open compartment, is placed above the moving web of open compartments and is moved in the direction and with the speed of the web of open compartments, such that each opening remains positioned above one open compartment during the filling step and that the space between at least part of the moulds is covered by said surface, preferably said second surface being an endless, rotatably moving belt.

The filling will then take place through the openings on this surface or belt, such that the product can only enter in the open compartments and not on the area between the compartments, which is covered. This is advantageous because the area between the open compartments, which typically serves as sealing area when closing the compartments, remains free of product, which ensures a better or easier seal.

The filled, open compartments (bottom compartments) are then closed with the second film. Preferably the first and second films are sealed together and a new open compartment is formed in each mould above the second film. These new open compartments are filled using any method and preferably one of the filling methods described herein before.

Preferred in the case of a second moving web is that the closing is done by continuously feeding the second film over and onto the web of open pouches and then preferably sealing the first film and second film together, typically in the area between the moulds and thus between the pouches and in the area between the bottom compartments. Preferred is that the closing material is fed onto the open compartments with the same speed and moving in the same direction as the open compartments.

The sealing can be done by any method. The sealing may be done in a discontinuous manner, for example by transporting the web of pouches to another sealing area and sealing equipment. However, the sealing is preferably done continuously and preferably with constant speed whilst the closed web of pouches moves continuously and with constant speed, and it may also preferably done in horizontal position, preferably also on said horizontal portion of the surface.

Preferred methods include heat sealing, solvent welding, and solvent or wet sealing. Hereby it may be preferred that only the area which is to form the seal, is treated with heat or solvent.

The heat or solvent can be applied by any method, preferably on the closing material, preferably only on the areas which are to form the seal.

Preferred may be that when heat sealing is used, a roller with cavities of the size of the part of the pouch, which is not enclosed by the mould, and having a pattern of the pouches, is (continuously) rolled over the web pouches, passing under the roller. Hereby, the heated roller contact only the area which is to be the sealing areas. Typically sealing temperatures are from 50 to 300° C., or even from 80 to up to 200° C., depending on the film material of course. Also useful is a movable, returnable sealing device, operating as the returnable, movable filling/dosing device above, which contacts the area between the moulds, around the edges, for a certain time, to form the seal, and then moves away from the sealing area, to return backwards, to start another sealing cycle. In the case of heat sealing, it is important that the sealing area of the second web to the first web does not overlap the sealing area of the individual first and/or second webs of pouches.

If solvent or wet sealing or welding is used, it may be preferred that also heat is applied. Preferred wet or solvent sealing/welding methods include applying selectively solvent onto the area between the moulds and preferably between the bottom compartments, or on the closing material, by for example, spraying or printing this onto these areas, and then applying pressure onto these areas, to form the seal. Sealing rolls and belts as described above (optionally also providing heat) can be used, for example.

The superposed and sealed webs of pouches can then be cut by a cutting device, which cuts the pouches from one another, in separate multi-compartment pouches.

The cutting can be done by any known method. It may be preferred that the cutting is also done in continuous manner, and preferably with constant speed and preferably while in horizontal position. However, the cutting step does not need to be done in horizontal position, nor continuously. For example the web of closed (sealed) pouches can be transported to the cutting device, e.g. to another surface, where the cutting device operates. Although, for ease of processing it may be preferred to perform the cutting step on the same surface as the previous steps.

The cutting device can for example be a sharp item or a hot item, whereby in the latter case, the that 'burns' through the film/sealing area. Preferred it may be a roller with sharp tools, such as a knife, with cavities of the size and pattern of the pouches, which rolls over the pouches such that the sharp tools only touch the area to be cut. Preferred may also be when the web of pouches is moving in one direction (e.g. continuously and/or horizontally, for example still on the endless surface herein) a static device contacting the area between the pouches along the direction of movement can be used, to cut the pouches in the direction of movement in a continuous manner. Then, the cutting between the pouches along the direction of the width of the web of pouches can be done by an intermittent cutting step, for example by applying a cutting device for a brief period onto the area, removing the cutting device and repeating this action with the next set of pouches.

The pouch is preferably made of a pouch material which is soluble in water, and has a water-solubility of at least 50%, preferably at least 75% or even at least 95%, as measured by the method set out here after using a glass-filter with a maximum pore size of 20 microns.

50 grams±0.1 gram of pouch material is added in a preweighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the % solubility or dispersability can be calculated.

Preferred pouch materials are polymeric materials, preferably polymers which are formed into a film or sheet. The pouch material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%.

The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000.

Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol.

Preferred for use herein are polymers which are from about 60% to about 98% hydrolysed, preferably about 80% to about 90% hydrolysed, to improve the dissolution characteristics of the material.

Most preferred pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The pouch material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

The pouches of the invention can have a large number of applications, including agricultural, pharmaceutical, cleaning, etc. Preferably the pouches of the invention contain cleaning compositions and in particular laundry or dishwashing compositions.

The pouches of the invention comprise at least one compartment containing a composition in liquid form. The rest of the compartments can contain compositions in liquid (including gels and pastes) or solid form (including powders, tablets, solid balls). Preferred pouches herein comprise at least three compartments comprising three similar or different compositions in liquid form, in particular gel compositions.

Also preferred herein are pouches comprising compositions in solid form in the bottom compartments and a composition in liquid form, particularly a gel, in the second compartment. Compositions in liquid form suitable for use herein can comprise suspended solids, such as flakes, beads, pearls, etc. The compositions can have different colours and appearance.

The different compartments can be made of films with different dissolution profiles, i.e, films that dissolve at different times. Film dissolution can be triggered by temperature, pH, etc.

In a preferred embodiment the bottom compartments are made of film material that only dissolves above about 50° C., more preferably above about 55° C. and preferably the bottom compartments contain rinse compositions to be delivered into the rinse cycle. Preferably the second compartment is made from a second film that dissolves in cold water, and preferably contains a main-wash cleaning composition to be delivered into the main-wash. This kind of pouches is preferred for use in automatic dishwashing. In another preferred embodiment, preferably for use in automatic dishwashing, one of the bottom compartments comprises bleach, another bottom compartment comprises a composition having a pH (as measured in a 1% aqueous solution at 20° C.) of about above 10, preferably about above 11, and another compartment comprises a enzyme, preferably the compositions of the three compartments are in liquid form, particularly as a gel and more particularly at least one of the compositions, preferably at least two of the compositions are in the form of anhydrous gel (i.e., a gel comprising less than 10% free water).

The compositions for use in the pouch of the invention are preferably cleaning compositions. Preferably, the cleaning compositions for use herein comprise traditional detergency components and can also comprise organic solvents having a cleaning function and organic solvents having a carrier or diluent function or some other specialised function. The compositions will generally be built and comprise one or more detergent active components which may be selected from bleaching agents, surfactants, alkalinity sources, enzymes, thickeners (in the case of liquid compositions), anti-corrosion agents (e.g. sodium silicate) and disrupting and binding agents (in the case of powder, granules or tablets). Highly preferred detergent components include a builder compound, an alkalinity source, a surfactant, an enzyme and a bleaching agent.

Solvents that can be used herein include: i) alcohols, such as benzyl alcohol, 1,4-cyclohexanedimethanol, 2-ethyl-1-hexanol, furfuryl alcohol, 1,2-hexanediol and other similar materials; ii) amines, such as alkanolamines (e.g. primary alkanolamines: monoethanolamine, monoisopropanolamine, diethylethanolamine, ethyl diethanolamine; secondary alkanolamines: diethanolamine, diisopropanolamine, 2-(methylamino)ethanol; ternary alkanolamines: triethanolamine, triisopropanolamine); alkylamines (e.g. primary alkylamines: monomethylamine, monoethylamine, monopropylamine, monobutylamine, monopentylamine, cyclohexylamine), secondary alkylamines: (dimethylamine), alkylene amines (primary alkylene amines: ethylenediamine, propylenediamine) and other similar materials; iii) esters, such as ethyl lactate, methyl ester, ethyl acetoacetate, ethylene glycol monobutyl ether acetate, diethylene glycol monoethyl ether acetate, diethylene glycol monobutyl ether acetate and other similar materials; iv) glycol ethers, such as ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol butyl ether and other similar materials; v) glycols, such as propylene glycol, diethylene glycol, hexylene glycol (2-methyl-2, 4 pentanediol), triethylene glycol, composition and dipropylene glycol and other similar materials; and mixtures thereof.

Surfactant

In the pouches of the present invention for use in automatic dishwashing the detergent surfactant is preferably low foaming by itself or in combination with other components (i.e. suds suppressers). Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$-$C_{20}$, preferably $C_{10}$-$C_{18}$ linear or branched; cationic surfactants such as chlorine esters (U.S. Pat. No. 4,228,042, U.S. Pat. No. 4,239,660 and U.S. Pat. No. 4,260,529) and mono $C_6$-$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$-$C_{18}$ primary alcohols), ethoxylated-propoxylated alcohols (e.g., BASF Poly-Tergent® SLF18), epoxy-capped poly(oxyalkylated) alcohols (e.g., BASF Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$-$C_{20}$ alkyl amine oxides (preferred amine oxides for use herein include $C_{12}$ lauryldimethyl amine oxide, $C_{14}$ and $C_{16}$ hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. No. 3,929,678, U.S. Pat. No. 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition. Preferred surfactant for use herein are low foaming and include low cloud point nonionic surfactants and mixtures of higher foaming surfactants with low cloud point nonionic surfactants which act as suds suppresser therefor.

Builder

Builders suitable for use in compositions herein include water-soluble builders such as citrates, carbonates and polyphosphates e.g. sodium tripolyphosphate and sodium tripolyphosphate hexahydrate, potassium tripolyphosphate and mixed sodium and potassium tripolyphosphate salts; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of composition.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Enzymes suitable herein include bacterial and fungal cellulases such as Carezyme and Celluzyme (Novo Nordisk A/S); peroxidases; lipases such as Amano-P (Amano Pharmaceutical Co.), M1 Lipase® and Lipomax® (Gist-Brocades) and Lipolase® and Lipolase Ultra® (Novo); cutinases; proteases such as Esperase®, Alcalase®, Durazym® and Savinase® (Novo) and Maxatase®, Maxacal®, Properase® and Maxapem® (Gist-Brocades); α and β amylases such as Purafect Ox Am® (Genencor) and Termamyl®, Ban®, Fungamyl®, Duramyl®, and Natalase® (Novo); pectinases; and mixtures thereof. Enzymes are preferably added herein as prills, granulates, or cogranulates at levels typically in the range from about 0.0001% to about 2% pure enzyme by weight of composition.

Bleaching Agent

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410).

Low Cloud Point Non-Ionic Surfactants and Suds Suppressers

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360-362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., BASF Poly-Tergent® SLF18) and epoxy-capped poly(oxyalkylated) alcohols (e.g., BASF Poly-Tergent®D SLF18B series of nonionics, as described, for example, in U.S. Pat. No. 5,576,281).

Preferred low cloud point surfactants are the ether-capped poly(oxyalkylated) suds suppresser having the formula:

$$R^1O-(CH_2-\underset{\underset{R^2}{|}}{CH}-O)_x-(CH_2-CH_2-O)_y-(CH_2-\underset{\underset{R^3}{|}}{CH}-O)_z-H$$

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta (methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

The compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components herein include colorants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressors (see WO-93/08876 and EP-A-0705324), polymeric dye transfer inhibiting agents, optical brighteners, perfumes, fillers and clay.

Liquid detergent compositions can contain low quantities of low molecular weight primary or secondary alcohols such as methanol, ethanol, propanol and isopropanol can be used in the liquid detergent of the present invention. Other suitable carrier solvents used in low quantities includes glycerol, propylene glycol, ethylene glycol, 1,2-propanediol, sorbitol and mixtures thereof.

Example

The compositions listed in table 1 are introduced in a three compartment PVA pouch. The pouch has two side-by side bottom compartments (compartments 1 and 2), separated by a bridge region, and a top compartment (compartment 3) superposed onto the bottom compartments. The pouch is made from a MonoSol M8630 film as supplied by MonoSol LLC. 0.7 g of compositions 1 and 2 are placed in compartments 1 and 2, respectively. The pouch is manufactured using a continuous process, moving in a horizontal rectilinear motion as herein described. According to this process a web of pouches is prepared by forming the pouch open compartments 1 and 2 with a PVA film and filling them. This film is then pin-pricked between compartments 1 and 2 and a second film of PVA is formed into the mould using vacuum. As the new open compartment (compartment 3) is formed the second PVA film is sealed to the first. Compartment 3 is then filled with 17.0 g of composition 3. A third film of PVA is placed over the open compartment and sealed against the second PVA film. The pouches are then slit, the vacuum released, and the pouches removed from the mould.

TABLE 1

| | Weight (%) | | |
|---|---|---|---|
| | Composition 1 | Composition 2 | Composition 3 |
| Dipropylene Glycol | 41.00 | 41.00 | 41.00 |
| Yellow Dye | 0.25 | 0 | 0 |
| Blue Dye | 0.36 | 0.81 | 0 |
| Water | 7.73 | 7.73 | 7.73 |
| Glycerine | 3.00 | 3.00 | 3.00 |
| Nonionic Surfactant | 47.66 | 47.46 | 48.27 |
| TOTAL | 100.00 | 100.00 | 100.00 |

The dimensions and values disclosed herein are not to be understood as being strictly limited to the exact numerical values recited. Instead, unless otherwise specified, each such dimension is intended to mean both the recited value and a functionally equivalent range surround that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for making a multi-compartment water-soluble pouch having at least three compartments and wherein at least one of the compartments contains a composition in liquid form, the process comprising the steps of:

a) providing a mould with at least two recesses, wherein the at least two recesses are connected by means of a bridge region;

b) drawing a first film into the mould to form at least two open compartments in the at least two recesses;

c) filling the open compartments;

d) pin-pricking the first film to create a pin-hole, wherein the pin-hole is placed on the film portion over the bridge region;

e) drawing a second film over the open compartments to close those compartments and to form a new open compartment, wherein the second film directly covers the pin-hole;

f) filling the open compartment formed from the second film; and g) placing a closure film over the new filled open compartment to close it.

* * * * *